US010149800B2

(12) United States Patent
Brown et al.

(10) Patent No.: US 10,149,800 B2
(45) Date of Patent: Dec. 11, 2018

(54) USER CONTROLLABLE NONCOLLAPSIBLE VARIABLE STREAM PHYSIOLOGICAL DISPENSER IN THE FORM OF A PATTERNED NIPPLE

(71) Applicants: Craig E. Brown, Chesterfield, MO (US); Robert J. Brown, Chesterfield, MO (US)

(72) Inventors: Craig E. Brown, Chesterfield, MO (US); Robert J. Brown, Chesterfield, MO (US)

( * ) Notice: Subject to any disclaimer, the term of this patent is extended or adjusted under 35 U.S.C. 154(b) by 42 days.

(21) Appl. No.: 14/544,773

(22) Filed: Feb. 18, 2015

(65) Prior Publication Data

US 2015/0164748 A1 Jun. 18, 2015

Related U.S. Application Data

(63) Continuation-in-part of application No. 29/463,410, filed on Nov. 14, 2013, now Pat. No. Des. 725,787.

(60) Provisional application No. 61/966,292, filed on Feb. 21, 2014.

(51) Int. Cl.
*A61J 11/00* (2006.01)
*A61J 9/04* (2006.01)

(52) U.S. Cl.
CPC ..... *A61J 11/0015* (2013.01); *A61J 9/04* (2013.01); *A61J 11/005* (2013.01)

(58) Field of Classification Search
CPC ..... A61J 11/0015; A61J 9/04; A61J 11/005
See application file for complete search history.

(56) References Cited

U.S. PATENT DOCUMENTS

| | | | | |
|---|---|---|---|---|
| 2,223,179 | A * | 11/1940 | Lougheed | A61J 11/0015 215/11.1 |
| 2,824,561 | A | 2/1958 | Mueller | |
| 3,134,495 | A * | 5/1964 | Carbonel | A61J 9/008 215/11.5 |
| 3,139,064 | A * | 6/1964 | Harle | A61J 11/001 116/309 |
| 3,610,248 | A | 10/1971 | Davidson | |
| 5,117,994 | A * | 6/1992 | Leblanc | A61J 11/0015 215/11.1 |
| 5,275,619 | A | 1/1994 | Engebretson et al. | |
| 5,779,071 | A | 7/1998 | Brown et al. | |
| 6,080,186 | A | 6/2000 | Pedersen et al. | |
| 6,454,788 | B1 | 9/2002 | Ashton | |
| 6,588,613 | B1 | 7/2003 | Pechenik et al. | |
| 6,883,672 | B2 | 4/2005 | Dunn et al. | |

(Continued)

FOREIGN PATENT DOCUMENTS

| | | |
|---|---|---|
| WO | WO/2005/110336 | 5/2004 |
| WO | WO/2007/084285 | 7/2007 |
| WO | WO/2009/116008 | 9/2009 |

*Primary Examiner* — Tri Mai
(74) *Attorney, Agent, or Firm* — Paul M. Denk

(57) ABSTRACT

A user controllable noncollapsible variable stream physiological dispenser for a container is disclosed which comprises a nipple having a top nipple portion which extends to an intermediate concave section which extends to a lower dome-shaped body and to a flange, the flange used for being held to a bottle by a collar, the nipple having openings formed in the top nipple portion, an open bottom provided at the flange with the nipple having a hollow body through which liquid may pass from the open bottom through the body and out the openings.

5 Claims, 13 Drawing Sheets

(56) References Cited

U.S. PATENT DOCUMENTS

| | | | | |
|---|---|---|---|---|
| 6,994,225 | B2 * | 2/2006 | Hakim | A61J 11/0015 215/11.1 |
| 7,029,491 | B2 | 4/2006 | Davis | |
| 7,234,607 | B2 | 6/2007 | Dunn et al. | |
| 7,540,388 | B2 | 6/2009 | Silver | |
| 7,712,617 | B2 | 5/2010 | Silver | |
| 2002/0158075 | A1 * | 10/2002 | Caldicott | A47G 19/2272 220/714 |
| 2003/0083696 | A1 | 5/2003 | Avital | |
| 2006/0011571 | A1 | 1/2006 | Silver | |
| 2012/0265245 | A1 | 10/2012 | Yamashita et al. | |

* cited by examiner

SECTION A-A

SECTION A-A

SECTION A-A

SECTION A-A

SECTION A-A

SECTION A-A

SECTION A-A

SECTION A-A

SECTION A-A

SECTION A-A

SECTION A-A

SECTION A-A

SECTION A-A

USER CONTROLLABLE NONCOLLAPSIBLE VARIABLE STREAM PHYSIOLOGICAL DISPENSER IN THE FORM OF A PATTERNED NIPPLE

CROSS REFERENCE TO RELATED APPLICATION

This application is a continuation-in-part of the provisional patent application having Ser. No. 61/966,292, filed on Feb. 18, 2014, and claims priority to the design patent application having Ser. No. 29/463,410, filed on Nov. 14, 2013, and also claims priority to the design patent application having Ser. No. 29/474,759, filed on Jan. 28, 2015, both of these earlier design applications are now abandoned.

FIELD OF THE DISCLOSURE

This disclosure generally relates to an artificial nipple for use with a nursing bottle and more particularly to a user controllable noncollapsible variable stream physiological dispenser for use with such a bottle.

BACKGROUND

Humans are composed of 70% water and individuals need to consume liquids every day in order to prevent dehydration. This is especially important with infants. Infants can lose a significant amount of water through their skin and also through respiration. Any significant loss of fluids is magnified with an elevated temperature or anything else that causes fluid losses from the body. Individuals of all ages consume liquids from containers. The feeding nipples on nursing bottles that infants use contain one or more apertures for liquid delivery. The feeding nipples frequently contain holes or other apertures for liquid delivery which are not exactly as advertised, causing further feeding problems. Some flow formula too freely and others require too much sucking. Both can cause problems for the infant. Apertures very frequently do not dispense at a predictable rate. Dispensing of liquid may be inconsistent, too rapid, or too slow. Delivery of liquid in such inconsistent rates is a problem when the liquid is being delivered to small infants and particularly to very small premature infants.

Frequently, especially with infants and small children, the fluid from the container flows out too quickly and leads to choking or spilling liquid on themselves. If an infant uses a nipple that releases liquid too quickly then the infant can choke or even aspirate the liquid. This may lead to pneumonia or suffering other medical sequela. Occasionally, the individual may want to consume liquid at a faster flow rate. However, because the aperture of the dispensing mechanism is too small this may not be possible. If a dispenser delivers a liquid too slowly, then the user, particularly an infant, can suck so vigorously that air is ingested into the gastrointestinal tract from around the dispenser or nipple during sucking, with adverse results.

If a nipple being used is found to be unsatisfactory, then the nipple must be changed and feeding has to be tried again. This process may have to be repeated a few times until a nipple having a desired flow rate is obtained. In addition, infants also require changed feeding speeds frequently as they grow, and this can only be done through changing of nipples, on the nursing bottles, through a trial and error practice. The current disclosure obviates this procedure. A common problem associated with the use of a nipple is the nipple collapsing during use or sucking by the infant. Nipple collapse does not occur during breast feeding. However, nipple collapse with use of an artificial nipple can impede feeding and be frustrating for the infant. Also, the nipple may easily be compressed, which results in the dispenser becoming unusable. If a container spout is being used, one or more new containers have to be obtained and tried. If an adult is using a sports bottle with the typically vertically adjustable spout, the bottle has to be removed from the mouth and readjusted until the rate of flow of the liquid becomes satisfactory.

Infants feed much more easily and efficiently when breast feeding. It is also known that use of the applicant's vented continuously positive pressure bottles can feed an infant similar to breast feeding. There are several reasons for this. It is known that breast milk is ejected with a positive pressure. This is why women have to wear breast pads in-between feedings. The applicant's bottles provide the feeding liquid with a positive pressure during the entire feeding process.

Currently, different sized holes in feeding nipples and various slits and combinations of slits are used to allow the release of feeding liquid. There are numerous problems encountered with these arrangements. When current nipples and apertures are used, the flow characteristics of the nipple cannot be modified or adjusted by the infant. Further, producing nipples having a uniformly very small aperture is extremely difficult. Also, of note, is that the current slits present in some nipples, which are called "cereal nipples" or "juice nipples," exhibit an inconsistent pattern. The flow may be significantly too rapid with the slits orientated in one direction. When the slits are orientated in another direction, there is frequently no flow. This is a particularly significant problem with newborns and smaller infants because they require controlled and controllable flow rates. If the flow is too rapid, then they can choke, gag, and aspirate the liquid. On the other hand, if the flow is too slow, then they do not obtain enough nourishment. This causes infant and caregiver frustration and should be avoided.

The flow rate provided by these nipples is unphysiological for multiple reasons. Normally breast milk is ejected from the breast with a positive pressure and is under the control of the infant during feeding. This is demonstrated during feeding and all other times, since women frequently have to wear breast pads to remain dry. All of the known nipples have a negative pressure and dispensers do not ever allow the infant to control the flow. The liquid is regulated by the negative pressure of the container and the size of the aperture in the nipple.

In addition, breast milk, which is an extremely valuable commodity, and formula, which is very expensive, are both sensitive and subject to nutritional breakdown, especially over time and if exposed to unphysiological amounts of elements, such as air. In particular, air that is allowed into a container may degrade Vitamins C, A, E, and lipids, and may affect other essential components of nutrition. The contamination of the liquid through one or more holes also introduces air into the liquid, the stomach, and the rest of the gastrointestinal tract, which may lead to gas, bloating, vomiting, colic, fussiness, and other infant maladies. Also, nipple confusion may easily occur typically due to collapsing nipples, excessive sucking pressures needed by the infant, air entrainment through and around the nipple, vacuum not relieved by the nipple arrangement, irregular and unregulated fluid flow, and other etiologies.

With known prior art unphysiological nipples and other dispensers, along with their containers, a large vacuum must be generated in the oral cavity of the infant and that vacuum must be transmitted to the nipple of the container. The need to generate this large vacuum is another nonphysiological aspect of the known bottles and nipples. This can cause abnormal mouth, including tooth, development, and ear and hearing problems with their attendant developmental delays, and also ear fluid and infections.

When a fully vented container is used, in order to simulate normal breast physiology, and a positive pressure is present in the container, fluid is released similarly to the breast, for the first time. Since there is a positive pressure, but no sphincters, as are present in normal breast milk ducts, to regulate the flow of liquid, the fluid exits the container very quickly, even when small holes are used in the nipple. Historically, these holes were lased, punched, and molded into the nipple. However, a hole that was imprecise very frequently resulted in feeding times that were significantly too long. Further, if the hole was too large then the infant might choke on the feeding liquid. The liquid may even dispense so quickly as to pour out of the mouth. Also, the orientation of the nipple and the bottle may change during feeding and result in very slow feeding in one position and very rapid feeding in another position or even change during feeding in the same position. This is obviously very frustrating, uncontrollable, and unphysiological. To compensate, the hole was purposefully made too small in an effort to reduce the flow to the infant so that the infant did not receive too much liquid at any time. This problem occurs with all dispensers, for all ages, but is exponentially worse with smaller infants due to their extremely small oral cavities. In light of that, manufacturers frequently made one hole and a smaller drip rate than desired for use. This resulted in feedings frequently lasting more than forty-five minutes, which is much longer than normal breast feeding. Another problem encountered with fully vented containers is that of forceful streams of liquid coming out of the container. This stream of fluid can easily choke an infant, especially if placed in the center of the nipple or dispenser, where it can easily be aspirated and cause medical problems, especially in the infant. Also, the infant cannot squeeze the feeding nipple like the nipple of the breast, in a variable pattern, and control the flow of liquid from the breast in a predictable manner.

When breast feeding, the infant can put pressure on the milk ducts in the breast and can generate a physiologically small amount of negative pressure in the mouth when more milk is needed. The milk ducts of the breast and the nipple will release more milk due to these negative pressures generated by the infant. However, present nipples do not allow for any regulation of the flow of liquid through a feeding nipple by the infant.

Bottles are frequently squeezed and turned upside down by infants, at all ages, and can cause a mess. This is due to the holes that are currently used in the nipples. A dispenser that does not leak or cause a mess would be desirable.

The present disclosure is designed to obviate and overcome many of the disadvantages and shortcomings experienced with prior nipple dispensing devices. The present disclosure is related to a user controllable noncollapsible variable stream physiological dispenser for use with a bottle. It would be desirable and advantageous to have a nipple dispenser that does not collapse during use. It would also be beneficial to have a nipple dispenser that can be used with a vented container to prevent any air from contaminating the liquid or formula stored in the container.

SUMMARY OF THE DISCLOSURE

In one form of the present disclosure a user controllable noncollapsible variable stream physiological dispenser for a container is disclosed which comprises a nipple having a top nipple portion which extends to an intermediate concave section which extends to a lower dome-shaped body and to a flange, the flange is used to be held to a bottle by a collar, the nipple having openings formed in the top nipple portion, an open bottom provided at the flange with the nipple having a hollow body through which liquid may pass from the open bottom through the body and out the openings.

In another form of the present disclosure, a user controllable noncollapsible variable stream physiological dispenser for a vented container comprises a nipple having a top nipple portion which extends to an intermediate concave section which extends to a lower dome-shaped body and to a flange, the nipple having openings formed in the top nipple portion, an open bottom provided at the flange with the nipple having a hollow body through which liquid may pass from the open bottom through the body and out the openings, and a vented container having an opening for receiving the nipple and for containing the liquid.

In still another form of the present disclosure, a user controllable noncollapsible variable stream physiological dispenser for a container comprises a nipple having a top nipple portion which extends to an intermediate concave section which extends to a lower dome-shaped body and to a flange, the flange used to be held to a bottle by a collar, the nipple having designed and patterned openings or slits formed in the top nipple portion, an open bottom provided at the flange with the nipple having a hollow body through which liquid may pass from the bottom through the body and out the openings, and a rib that spans from the bottom to the top nipple portion, with the rib for preventing the nipple from collapsing during use.

In light of the foregoing comments, it will be recognized that the present disclosure provides a user controllable noncollapsible variable stream physiological dispenser for use with a container.

The present disclosure provides a user controllable noncollapsible variable stream physiological dispenser for use with a container that can be easily employed with highly reliable results.

When providing nutrition to an infant it is important to provide the nutrition in a physiological pleasing and stimulating manner. In order to provide liquid or formula physiologically to infants, it is beneficial to provide a positive pressure to the liquid so that it is spontaneously released, and such release may be increased by the suction provided by the infant. This is exactly what physiologically occurs when an infant is breast feeding. When the contents of a container or bottle are under positive pressure, especially a thin liquid such as a feeding liquid for infants, even a very small aperture in the container results in an extremely fast and copious release of liquid from the container. This may be too much for the infant to handle. This may result in the infant choking and loss of liquid from the mouth of the infant and the container. Physiological release may also be desirable with other releases of the contents of the container.

The present disclosure relates to a nipple with one or more variably sized and variably placed infant or other user controllable leak-resistant apertures for the release of the contents of a container. If desired, the apertures can be patterned so that the infant or user can rotate the container to change the flow of the liquid contents of the container. Also, the apertures may be angled with respect to the surface of the nipple to control the flow from the container. The apertures may be orientated such that flow patterns are consistently able to be regulated on demand, for the first time, regardless of the orientation of the container, for the first time. The apertures may be positioned so that one or more are relatively vertical, one or more are relatively horizontal, and one or more are relatively diagonal. The apertures may be placed perpendicular to or tangentially to the surface of the material and even be irregularly shaped, such as what happens when the apertures are made by a drill, screw, or other irregular device or tool. This slows the flow of the liquid, which is especially helpful to premature and small infants. The present nipple or dispenser also may contain one or more ribs or other formation of material to prevent collapse of the nipple during use. Such provides for a reinforcement of the nipple.

The nipple of the present disclosure may be configured to aerosolize or atomize the contents of the bottle, if desired, when turned to a certain position. This provides for any combination of dripping and spraying of the contents of the container or bottle. Also, the nipple or dispenser may be provided with an irregularly shaped dispensing end to mimic the surface texture of the female breast during lactation.

It is also desirable to combine the nipple of the present disclosure with a single or double venting mechanism that prevents air from mixing with the contents of the container. A single venting mechanism contains a venting tube leading from the superior aspect of the container to the inferior aspect of the container. The double venting mechanism consists of a flange on the inferior aspect of the container closure which accepts a liquid reservoir and its distal end venting tube which extends to the inferior aspect of the container. The closure also has an inferiorly directed internal venting tube which extends into the volumetric center of the reservoir, with the closure containing an aperture through its wall in contact with the above internal venting tube. This allows for continuous venting from the atmosphere to the inferior and inferior aspect of the container. Another venting mechanism consists of using an insert typically sitting on the superior aspect of the container that conducts airflow from the atmosphere to the internal venting tube mentioned above and then into the inferior aspect of the container. All of these venting mechanisms allow for continuous, automatic, and on-demand venting of the container. The nipple may also contain a narrowing and/or extra material in the neck region between the distal dispensing end and the proximal end that mates with the container. This allows for physiological elongation of the dispenser.

If used for an infant, the surface of the nipple dispenser may be irregular to mimic the surface of the female breast and the apertures may be introduced into the surface of the nipple at any angle. The dispensing portions of all embodiments discussed herein may be of any texture and may be a soft material, such as silicone used for infant feeding nipples. A firmer material, such as a spout for a drinking cup for older children may also be used. The nipple dispenser of the present disclosure may also be used with a sports bottle. The apertures may be located in any position on the nipple. A rib may be internally provided that extends longitudinally in the dispenser which prevents the closure or collapsing of the dispenser during use. The nipple may have a cover for maintaining the hygiene of the dispenser when not in use.

A slit or slits are provided through the surface of the nipple of the present disclosure and are located distally from the traditional dispensing center of the nipple. The slits may be perpendicular or tangential in nature and orientation. If a slower flow is desired, then the slits may be tangential. The tangential slits provide a smaller aperture than compared to slits that are perpendicular to the surface of the nipple when compressed. Due to the small size of the aperture when the slits are tangential, a slower physiological dripping or streaming of liquid is produced. Also, the apertures or slits are larger and more easily manufactured than currently available apertures which are 0.012 in. This is particularly useful when the material used to construct the nipple dispenser of the present disclosure is a food grade silicone which is very difficult to produce apertures in due to its physical nature. Furthermore, any configuration, shape, combination, and number of apertures may be used, and when coupled with a tangential nature of the apertures, an infinite number of flow characteristics and speeds are possible and obtainable. For example, the apertures may be arranged intersecting each other, which allow for even more combinations of flow.

The degree of the tangential cut of the slits to their surface allows for variably and adjustable formed streams and adjustable flow characteristic patterns for the liquid exiting the nipple. The tangential pattern may be made so as to produce liquid that exits in a helical pattern, a pulsing pattern, liquid that exits and clings to the nipple for a short distance, a fine mist of liquid or spray, or multiple other patterns. The desired patterns and amount of flow is quickly and easily selectable by the user by rotating the position of the dispenser and the infant may also change the pattern and flow amount by compressing the dispenser by different amounts and in different places with the tongue, lips, and other portions of the oral cavity. This is similar to breast feeding since the milk glands have muscles within them that are constantly varying the presentation of liquid to the infant and the infant is sucking in different amounts and patterns. One very useful pattern consists of five slots approximately 2 mm long, circularly arranged around the upper end of the nipple. Another consists of 6 radial slots extending from just distal from the center of the end of the nipple and radially arranged, and are typically approximately 2.8 mm in length. When the slots are symmetrically placed, the flow is similar in any position and typically flows approximately 1 to 3 drops per second. When the slits are asymmetrically arranged, it is easy to adjust the arrangement of the bottle to produce a typical 1 drop per second flow, or the bottle can be turned slightly, to make the flow 2 or 3 drops per second. This way, the flow rate of the formula from the bottle can be easily controlled by the mother. Furthermore, various indicia may be imprinted on the bottle, or even on the sides of the nipple, to indicate a desired flow rate, depending on the orientation of the nipple when delivered to the infant's mouth. A particular useful pattern is one that consists of three non-contiguous apertures slightly distal to the traditional aperture of a nipple. The three apertures have one that is vertically oriented, one horizontally oriented, and one diagonally oriented around the distal aspect of the feeding nipple. Another desirable pattern consists of one horizontal aperture and one vertical aperture. Both of these arrangements provide for consistently regulated infant flow patterns in all positions of the bottle. A further desirable pattern comprises apertures or slits of varying lengths with the longest slit being substantially opposed to the shortest slit to control the flow rate from the fastest flow rate to the slowest flow rate. In particular, the fastest flow rate may be about one ounce per minute and the slowest flow rate may be about one ounce per one minute and forty-five seconds.

These and other advantages of the present disclosure will become apparent to those skilled in the art after considering the following detailed specification in conjunction with the accompanying drawings.

DETAILED DESCRIPTION OF PREFERRED EMBODIMENTS

Figure 1:
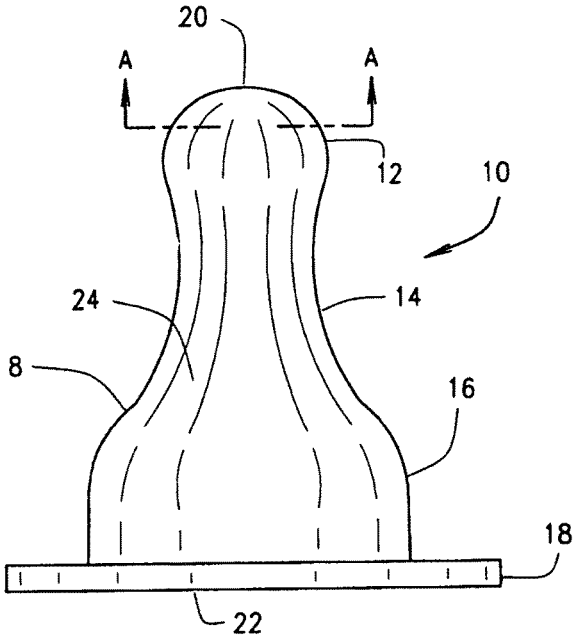
FIG. 1 is a perspective view of a nipple constructed according to the present disclosure.

Referring now to the drawings, wherein like numbers refer to like items, number 10 identifies a preferred embodiment of a noncollapsible nipple constructed according to the present disclosure. With reference now to FIG. 1, the noncollapsible nipple 10 comprises a nipple bulbous end portion 12 which extends to an intermediate concave section 14 which extends to a lower dome-shaped body 16 and then to a flange 18. The flange 18 is used to be held to a bottle (not shown) by a collar (not shown), as will be explained further herein. The nipple 10 has openings, apertures, or slits 20 formed in the nipple end portion 12. An open bottom 22 is also provided at the flange 18. The nipple 10 also has a generally hollow body 24 through which a liquid may pass from the bottom 22 through the body 24 and out the openings 20. The nipple 10 may be placed in a mouth of an infant for feeding purposes. The nipple 10 may be constructed from any suitable material such as silicone or latex.

Figure 1A:
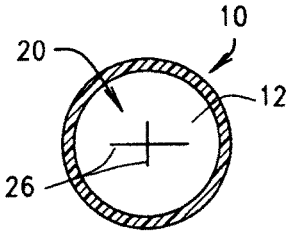
FIG. 1A is a cross-sectional view of the nipple shown in FIG. 1 taken along the plane of line A-A.

FIG. 1A shows a top view of the nipple end portion 12 of the nipple 10. The opening 20 is shown to have a plus or cross shape 26. The shape 26 may have any desired length. One slit may be longer than the other. All of the slits forming the opening may have a length that may be equal, or different, and may be arranged symmetrical, or asymmetrical, in order to regulate formula flow.

Figure 1B:
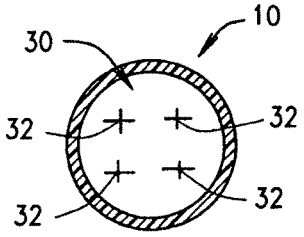
FIG. 1B is a cross-sectional view of another embodiment of the nipple shown in FIG. 1 taken along the plane of line A-A.

FIG. 1B depicts a top view of another embodiment of an opening 30 that may be formed in the nipple end portion 12.

The opening 30 comprises four plus or cross shaped openings 32. The openings 32 are used to regulate formula flow when used by an infant.

Figure 1C:
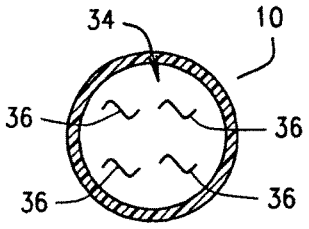
FIG. 1C is a cross-sectional view of another embodiment of the nipple shown in FIG. 1 taken along the plane of line A-A.

FIG. 1C is another embodiment of an opening 34 which comprises four tilde shaped openings 36. The tilde shaped openings 36 may be variably arranged and sized as desired.

Figure 1D:
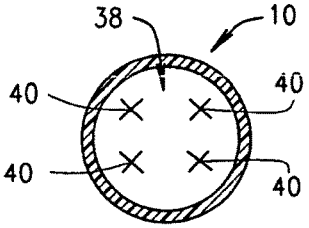
FIG. 1D is a cross-sectional view of another embodiment of the nipple shown in FIG. 1 taken along the plane of line A-A.

FIG. 1D shows another top view of an opening 38 that may be used in the nipple end portion 12 of the nipple 10. The opening 38 comprises four X shaped openings 40 that are spaced symmetrically about the nipple end portion 12.

Figure 1E:
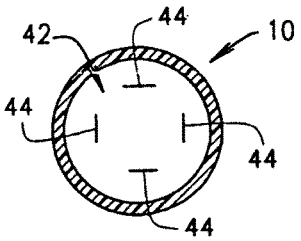
FIG. 1E is a cross-sectional view of another embodiment of the nipple shown in FIG. 1 taken along the plane of line A-A.

With reference to FIG. 1E, another top view of an opening configuration 42 is shown that has four slit shaped openings 44 formed in the nipple 10. The slits 44 are spaced symmetrically around the nipple end portion 12 in a squared configuration.

Figure 1F:
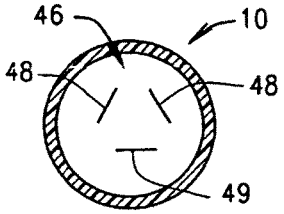
FIG. 1F is a cross-sectional view of another embodiment of the nipple shown in FIG. 1 taken along the plane of line A-A.

FIG. 1F illustrates another possible configuration 46 having three slits 48 formed in a triangular fashion.

Figure 1G:
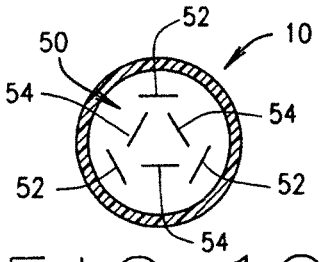
FIG. 1G is a cross-sectional view of another embodiment of the nipple shown in FIG. 1 taken along the plane of line A-A.

FIG. 1G depicts a configuration 50 having three inner slits 52 formed in a triangular shape and three outer slits 54 formed in a triangular shape with the outer slits 54 being offset from the inner slits 52.

Figure 1H:
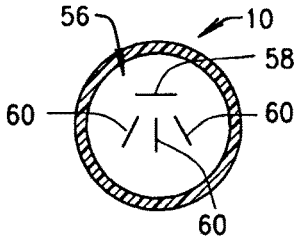
FIG. 1H is a cross-sectional view of another embodiment of the nipple shown in FIG. 1 taken along the plane of line A-A.

FIG. 1H shows another configuration 56 that has a horizontal slot 58 and three angular slits 60 positioned below the horizontal slit 58.

Figure 1I:
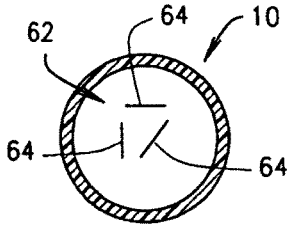
FIG. 1I is a cross-sectional view of another embodiment of the nipple shown in FIG. 1 taken along the plane of line A-A.

FIG. 1I illustrates a configuration 62 having three slits 64, with one of the slits 64 being arranged horizontally, a second one of the slits 64 being positioned vertically, and the final one of the slits 64 being positioned inclined or diagonally arranged.

Figure 1J:
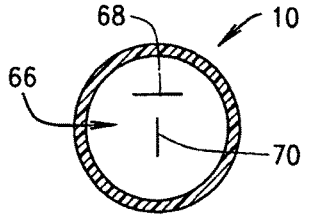
FIG. 1J is a cross-sectional view of another embodiment of the nipple shown in FIG. 1 taken along the plane of line A-A.

FIG. 1J shows a configuration 66 having a horizontal slit 68 and a vertical slit 70. The horizontal slit 68 is above the vertical slit 70 and has a T shaped formation.

Figure 1K:
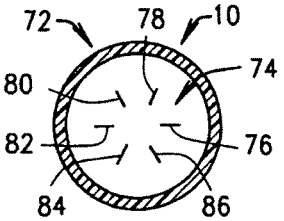
FIG. 1K is a cross-sectional view of another embodiment of the nipple shown in FIG. 1 taken along the plane of line A-A.

With reference now to FIG. 1K, a configuration 72 is shown which provides a no drip nipple 74. The configuration 72 comprises slits 76, 78, 80, 82, 84, and 86 distributed about the nipple 74. The slit 76 is at the zero degree position, the slit 78 is at the 60 degree position, the slit 80 is at the 120 degree position, the slit 82 is at the 180 degree position, the slit 84 is at the 240 degree position, and the slit 86 is at the 300 degree position.

Figure 1L:
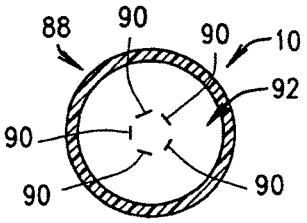
FIG. 1L is a cross-sectional view of another embodiment of the nipple shown in FIG. 1 taken along the plane of line A-A.

FIG. 1L illustrates a configuration 88 that has five slits 90 formed in the shape of a pentagon. This configuration 88 may be used to provide a nipple 92 that does not drip liquid or formula out of the nipple 92.

Figure 1M:
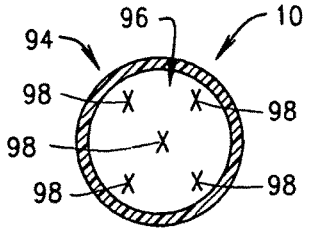
FIG. 1M is a cross-sectional view of another embodiment of the nipple shown in FIG. 1 taken along the plane of line A-A.

FIG. 1M depicts a nipple 94 having a configuration 96 consisting of five X shaped slits 98 positioned about the nipple 94. The slits 98 are also arranged in an X-like pattern on the nipple 94.

As can be appreciated, the various configurations 20, 30, 34, 38, 42, 46, 50, 56, 62, 66, 72, 88, and 94 provide orally activated apertures or openings which release liquid at any desirable rate when pressure is applied to the nipple. The various configurations provide for consistently regulated flow patterns of liquid in all positions of orientation of the bottle or container in which the liquid is stored. Further, the various configurations provide adjustable and optimal flow from the bottle or container. These configurations may be made more or less symmetrical and adjusted for amounts of flow desired depending on the positioning of the nursing bottle and its nipple.

Figure 2:
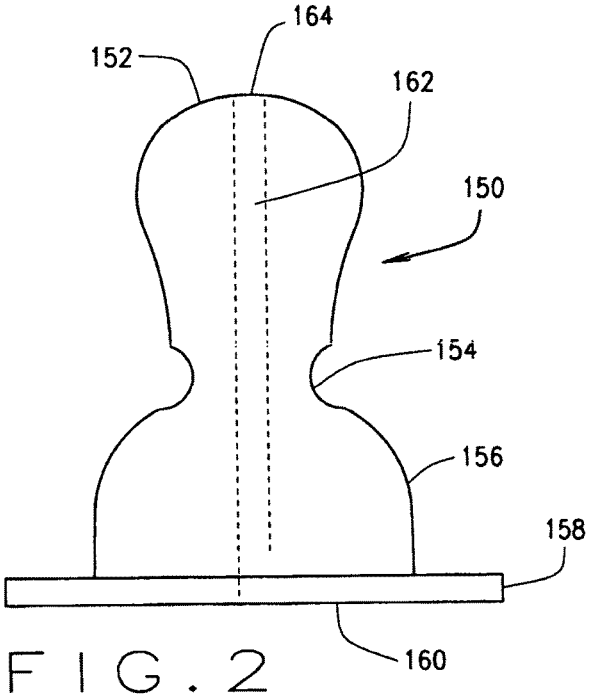
FIG. 2 is a cross-sectional view of an interior of another embodiment of a nipple constructed according to the present disclosure.

Referring now to FIG. 2, a cross-sectional interior view of another embodiment of a nipple 150 is shown. The nipple 150 comprises a nipple end portion 152 which extends to an intermediate concave section 154 which extends to a lower dome-shaped body 156 and then to a flange 158. The concave section 154 allows for elongation of the nipple 150, which is similar to a mammal nipple. The nipple 150 also has an open bottom 160 and a rib 162 that spans from the bottom 160 to the nipple end portion 152. The rib 162 prevents the nipple 150 from being collapsed during use. The flange 158 is used to secure the nipple 150 in place between a collar (not shown) and a top of a bottle (also not shown). The nipple 150 also has openings, apertures, or slits 164 formed in the nipple end portion 152. Any liquid within a bottle may flow through the nipple 150 at a desired rate.

Figure 3:
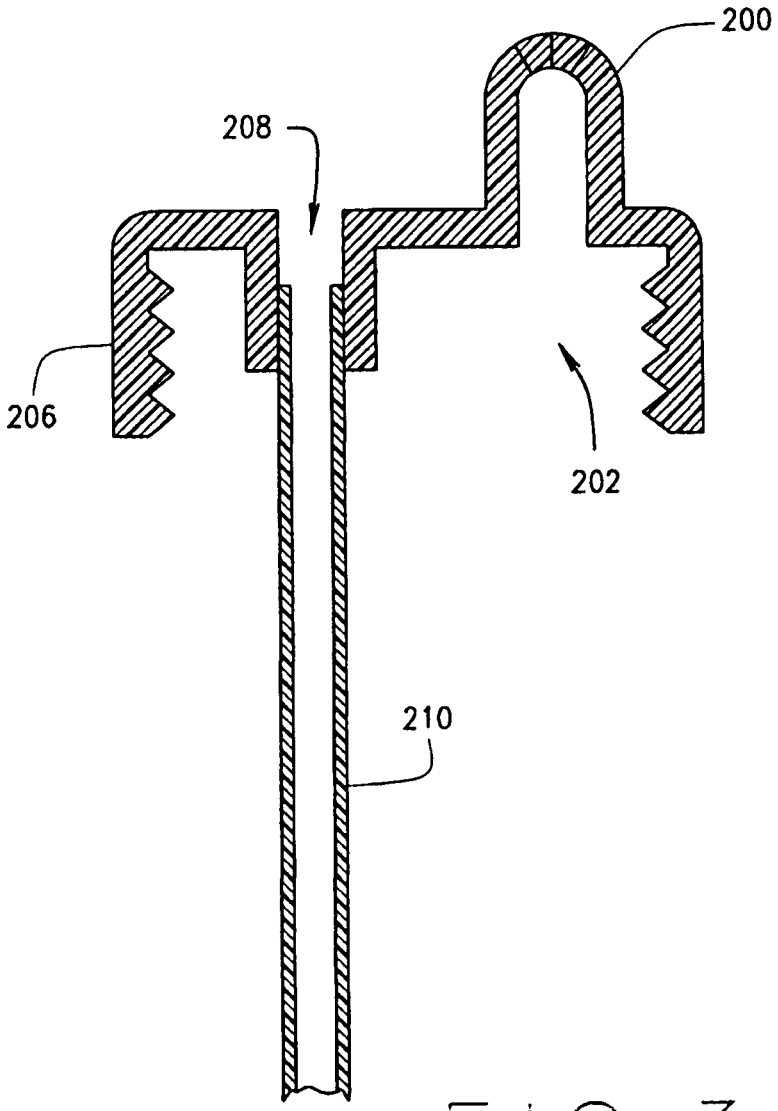
FIG. 3 is a cross-sectional view of another embodiment of a nipple constructed according to the present disclosure and with a venting mechanism.

FIG. 3 shows a cross-sectional view of a nipple 200 constructed according to the present disclosure being secured in placed over an opening 202 of a container or a bottle (not shown) by use of a closure device 206, such as a threaded collar. Although not shown, the bottle may contain a liquid, such as infant formula or milk. The closure device 206 has incorporated therein a vent opening 208 and a venting tube 210. The venting tube 210 extends into the interior of the bottle 204 and through the vent opening 208. The venting tube 210 prevents air from mixing with the contents of the bottle. The venting tube 210 is preferably approximately one-third the size of the region of release of the container contents or any size that provides air into the bottle at a sufficient rate. The venting tube 210 should have a diameter that is large enough that air preferentially enters the bottle through the vent opening 208, and not so large that liquid escapes through the vent opening 208 itself. The vent opening 208 and the venting tube 210 allow for continuous, automatic, and on-demand venting of the bottle. The type of vent structure shown in our U.S. Pat. No. 5,779,071 may be employed, and its teachings may be incorporated herein by reference. As can be appreciated, any of the nipples disclosed herein may be used with the device 206.

Figure 4:
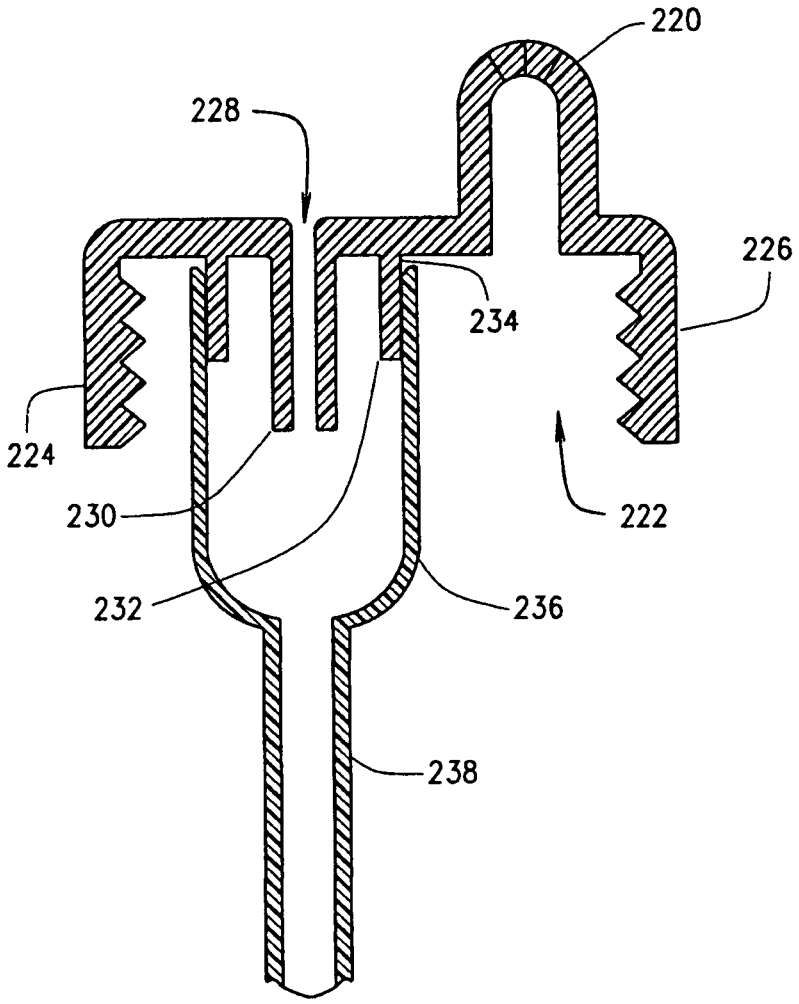
FIG. 4 is a cross-sectional view of another embodiment of a nipple constructed according to the present disclosure and an accompanying venting mechanism.

With reference now to FIG. 4, a cross-sectional view of another embodiment of a nipple 220 is shown secured in place over an opening 222 of a container or a bottle 224 by use of a threaded collar closure device 226. The closure device 226 has incorporated therein a vent opening 228 and an internal vent 230. A circumferential flange 232 extends downwardly from the closure device 226 and the flange 232 has an exterior surface 234 upon which a liquid reservoir 236 having a reservoir extension 238 is placed. The internal vent 230 extends into the volumetric center of the liquid reservoir 236. The vent opening 228 allows for continuous venting from the atmosphere to the inferior aspect of the bottle 224. This is similar to what is shown in our U.S. Pat. No. 5,779,071. The current art does not utilize an insert. Again, any of the nipples disclosed herein may be used in combination with the device 226.

Figure 5:
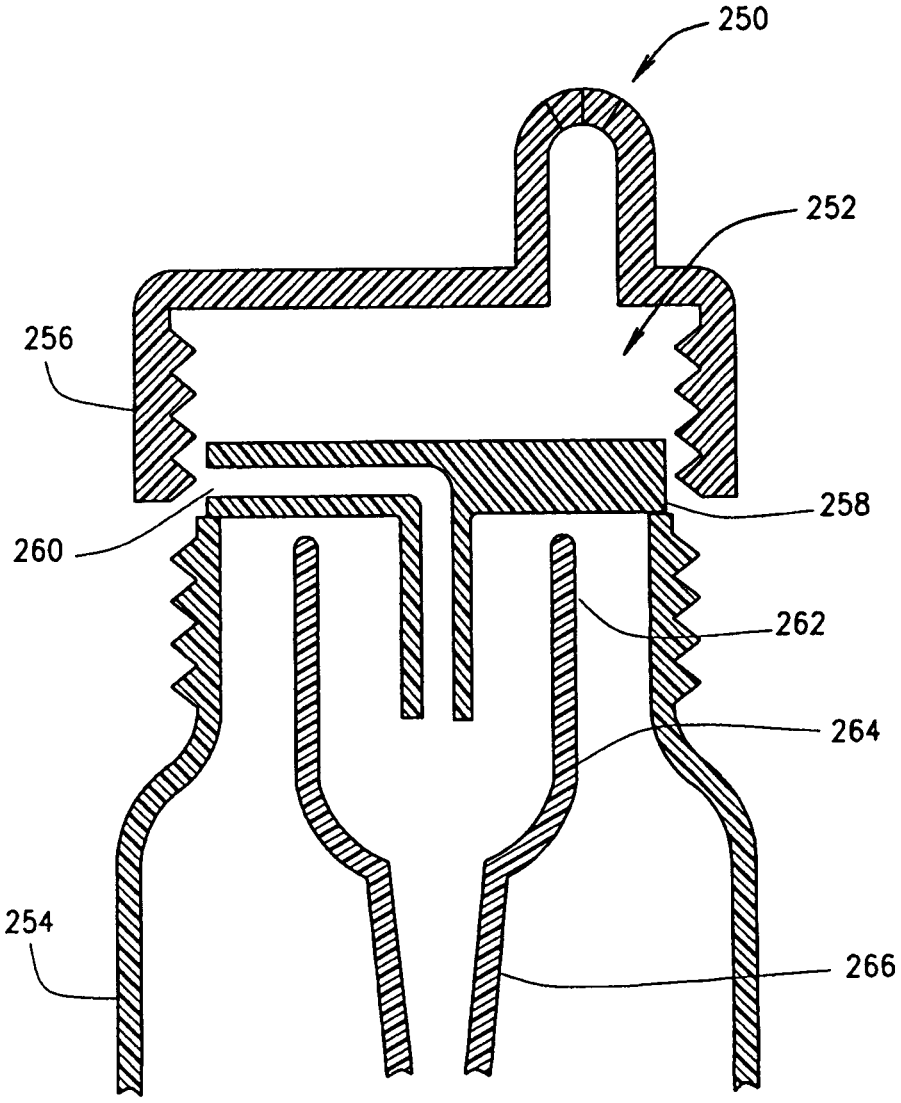
FIG. 5 is a cross-sectional view of another embodiment of a nipple constructed according to the present disclosure and a venting mechanism.

FIG. 5 illustrates a cross-sectional view of another embodiment of a nipple 250. The nipple 250 is placed over an opening 252 of a container or a bottle 254 by use of a threaded collar 256. An insert 258 is associated with the bottle 254. The insert 258 has a channel 260 and an internal vent tube 262. A reservoir 264 having a reservoir extension 266 is connected to the insert 258. The channel 260 and the internal vent tube 262 conducts airflow from the atmosphere into the inferior aspect of the bottle 254. This provides for continuous, automatic, and on-demand venting of the bottle 254. Any of the nipples disclosed and described herein may be used as the nipple 250.

Figure 6:
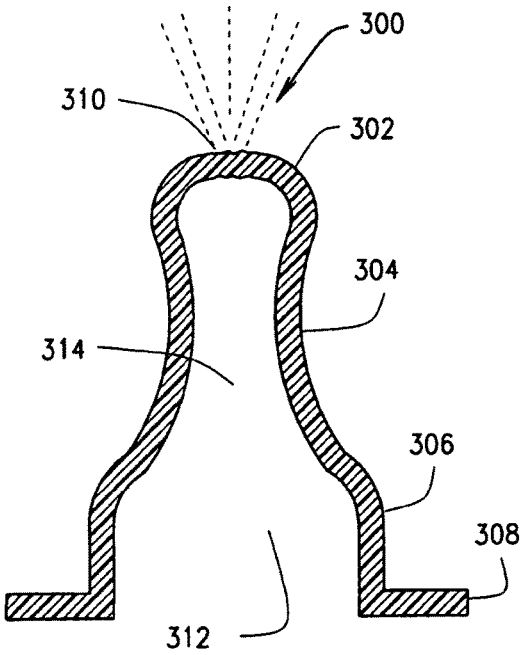
FIG. 6 is a cross-sectional view of an interior of another embodiment of a nipple constructed according to the present disclosure.

Referring now in particular to FIG. 6, a cross-sectional view of another nipple 300 constructed according to the present disclosure is shown. The nipple 300 is used to provide atomization of the contents of a bottle upon which the nipple 300 is placed. Some infants may prefer that the liquid being dispensed from a bottle be atomized. The nipple 300 comprises a nipple end portion 302 which extends to an intermediate concave section 304 which extends to a lower dome-shaped body 306 and then to a flange 308. The flange 308 is used to be held to a bottle (not shown) by a collar (not shown). The nipple 300 has openings, apertures, or slits 310 formed in the nipple end portion 302. An open bottom 312 is also provided at the flange 308. The nipple 300 also has a generally hollow body 314 through which a liquid may pass from the bottom 312 through the body 314 and out the openings 310. The nipple 300 may be placed in a mouth of an infant for providing atomization of the liquid contained within a bottle.

Figure 7:
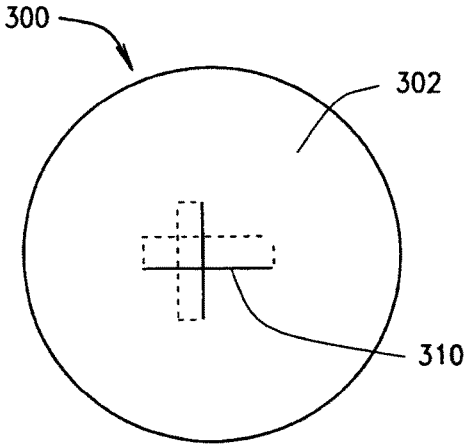
FIG. 7 is an enlarged top view of the nipple shown in FIG. 6.

FIG. 7 depicts an enlarged top view of the nipple 300. The nipple 300 has the nipple end portion 302 and the slits 310 formed therein. The slits 310 are made at various angles tangentially to the surface. This facilitates variation of the flow of liquids from within a bottle. Any number of configurations of slits 310 may be used and are variably configurable.

Figure 8:
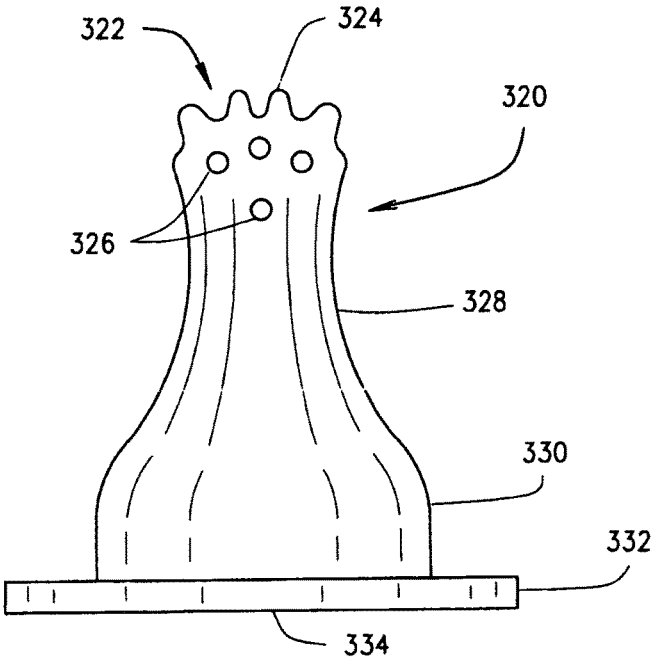
FIG. 8 is a perspective view of another embodiment of a nipple constructed according to the present disclosure.

Referring to FIG. 8, another embodiment of a nipple 320 constructed according to the present disclosure is illustrated. The nipple 320 comprises a top nipple portion 322 having irregular shaped ridges 324 and various openings 326. The openings 326 may be placed at an angle on the nipple 320. The nipple 320 also comprises an intermediate concave section 328 which extends to a lower dome-shaped body 330 and then to a flange 332. An open bottom 334 is provided in the nipple 320. The nipple 320 also has a generally hollow body through which liquid may flow from the bottom 334 to the openings 326. The irregular shaped ridges 324 may be preferred by some infants due to the ridges 324 mimicking the surface of a natural breast.

Figure 9:
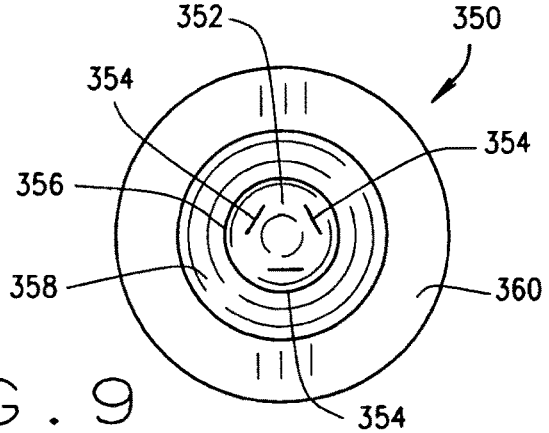
FIG. 9 is a top view of another embodiment of a nipple constructed according to the present disclosure.

FIG. 9 shows a top view another embodiment of a nipple 350 constructed according to the present disclosure. The nipple 350 comprises a top nipple portion 352 having various openings 354 positioned about the top nipple portion 354. The openings 354 are configured in a triangular shape and are formed by slicing though the top nipple portion 352 at a forty-five degree angle. The nipple 350 further comprises an intermediate concave section 356 which extends to a lower dome-shaped body or section 358 and then to a flange 360. Although not shown in this particular view, the nipple 350 has an open bottom and a generally hollow body. As can be appreciated, liquid, such an infant formula, may flow through the open bottom, the hollow body, and out through the openings 354.

Figure 10:
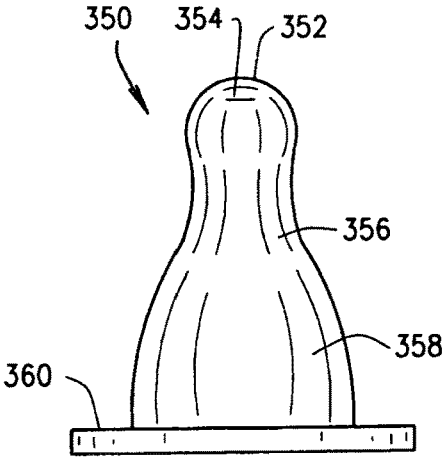
FIG. 10 is a side view of the nipple shown in FIG. 9.

With reference now to FIG. 10, a side view of the nipple 350 is shown. The nipple 350 has one of the openings 354 positioned into view in this figure. The nipple 350 also has the top nipple portion 352, the intermediate concave section 356, the dome-shaped body 358, and the flange 360.

Figure 11:
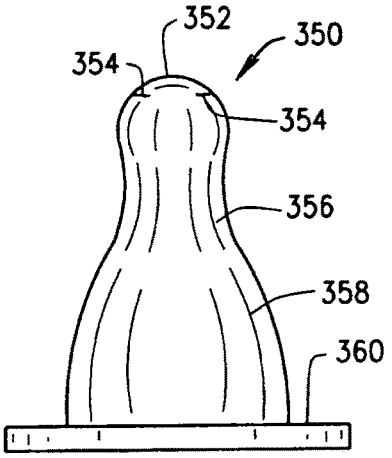
FIG. 11 is a side view of the nipple shown in FIG. 10 being rotated.

FIG. 11 depicts the nipple 350 in a rotated position relative to the position shown in FIG. 10 so that the other openings 354 are displayed. The nipple 350 has two of the openings 354 positioned into view in this figure. The nipple 350 also has the top nipple portion 352, the intermediate concave section 356, the dome-shaped body 358, and the flange 360.

Figure 12:
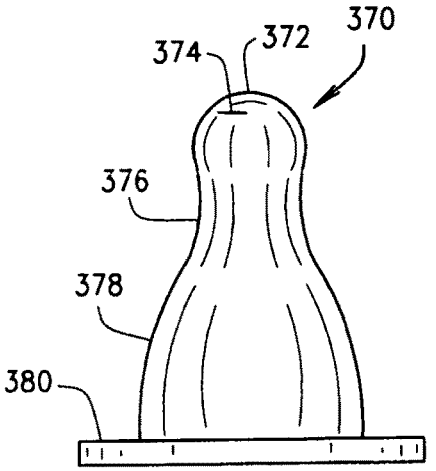
FIG. 12 is a side view of another embodiment of a nipple constructed according to the present disclosure.

With reference now to FIG. 12, another embodiment of a nipple 370 is illustrated. This nipple 370 is similar to the nipple 360 with the exception of having less openings; In particular, the nipple 370 only has two openings formed in the nipple 370. The nipple 370 comprises a top nipple portion 372 having two openings 374 positioned about the top nipple portion 372 of which only one of the openings 374 is shown in this figure. The openings 374 are configured in a triangular shape with one of the legs of the triangle missing. The openings 374 and are formed by slicing though the top nipple portion 372 at a forty-five degree angle. The nipple 370 further comprises an intermediate concave section 376 which extends to a lower dome-shaped body or section 378 and then to a flange 380.

Figure 13:
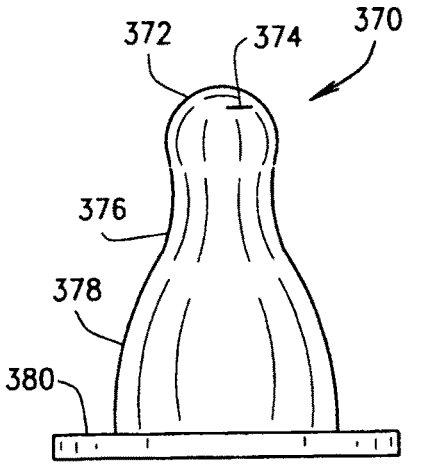
FIG. 13 is a side view of the nipple shown in FIG. 12 being rotated.

FIG. 13 shows the nipple 370 rotated to depict the other opening 374 that is formed in the top nipple portion 372. The concave section 376, the dome-shaped body 378, and the flange 380 are also shown. As can be appreciated, the flange 380 has an opening and the nipple 370 has a hollow body though which a liquid may flow through and out the openings 374.

Figure 14:
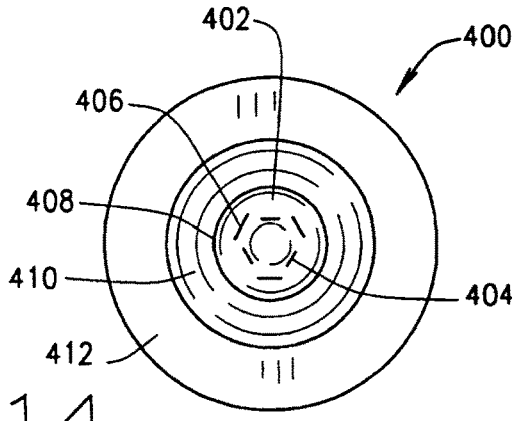
FIG. 14 is a top view of another embodiment of a nipple constructed according to the present disclosure.

Referring now to FIG. 14, a top view of another embodiment of a nipple 400 is shown. The nipple 400 comprises a top nipple portion 402 having a first set of openings 404 and a second set of openings 406 positioned about the top nipple portion 402. The first set of openings 404 are configured in a triangular shape and the second set of openings 406 also configured in a triangular shape. The first set of openings 404 are interior to the second set of openings 406 and the first set of openings 404 are offset from the second set of openings 406. The openings 404 and 406 are formed by slicing though the top nipple portion 402 at a forty-five degree angle. The nipple 400 further comprises an intermediate concave section 408 which extends to a lower dome-shaped body or section 410 and then to a flange 412. Although not shown in this view, the nipple 400 has an open bottom and a generally hollow body. Liquid, such an infant formula, may flow through the open bottom, the hollow body, and out through the openings 404 and 406.

Figure 15:
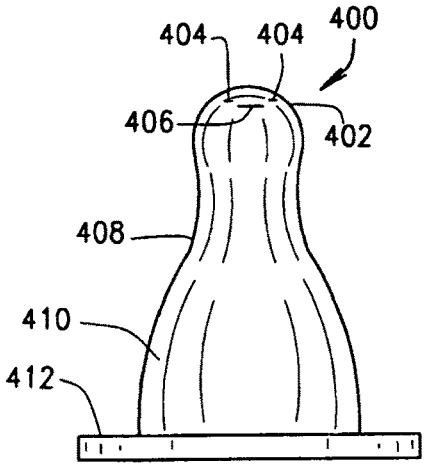
FIG. 15 is a side view of the nipple shown in FIG. 14.

With reference now to FIG. 15, a side view of the nipple 400 is shown. The nipple 400 has the openings 404 and 406 positioned into view in this figure. The first set of openings 404 are higher than the second set of openings 406 on the top nipple portion 402. The nipple 400 also has the top nipple portion 402, the intermediate concave section 408, the dome-shaped body 410, and the flange 412.

Figure 16:
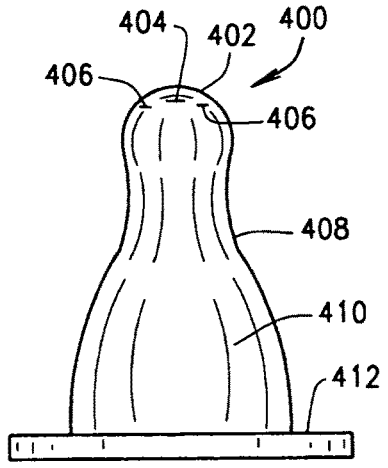
FIG. 16 is a side view of the nipple shown in FIG. 15 being rotated

FIG. 16 depicts the nipple 400 in a rotated position relative to the position shown in FIG. 15 so that the other openings 404 and 406 are displayed. Again, the first set of openings 404 are positioned higher on the top nipple portion 402 than the second set of openings 406. The nipple 400 also consists of the top nipple portion 402, the intermediate concave section 408, the dome-shaped body 410, and the flange 412.

Figure 17:
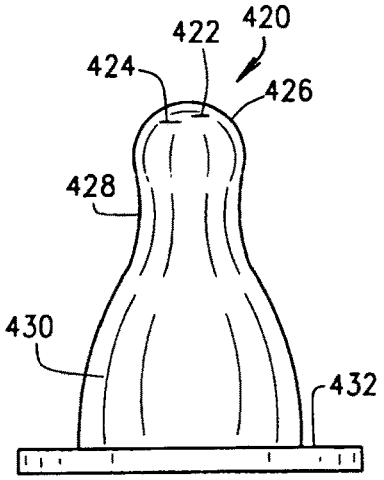
FIG. 17 is a side view of another embodiment of a nipple constructed according to the present disclosure.

Referring now to FIG. 17, another embodiment of a nipple 420 is illustrated. This nipple 420 is similar to the nipple 400 with the exception of having less openings. In particular, the nipple 420 only has two openings formed as the first set of openings 422 and tow openings formed as the second set of openings 424 in a top nipple portion 426 of the nipple 420. The openings 422 and 424 are formed in the top nipple portion 426 by slicing through the top nipple portion 426 at a forty-five degree angle. The nipple 420 further comprises an intermediate concave section 428 which extends to a lower dome-shaped body or section 430 and then to a flange 432. The first set of openings 422 are higher than the second set of openings 424. Also, the first set of openings 422 are offset from the second set of openings 424.

Figure 18:
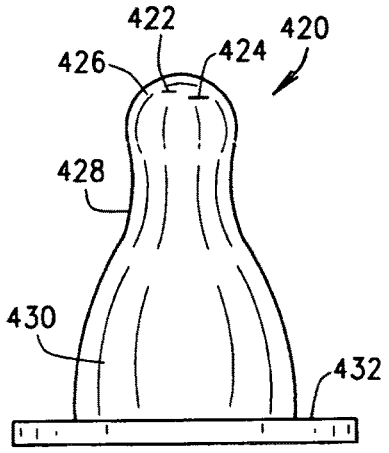
FIG. 18 is a side view of the nipple shown in FIG. 17 being rotated.

FIG. 18 shows the nipple 420 rotated to depict the other openings 422 and 424 that are formed in the top nipple portion 426. The concave section 428, the dome-shaped body 430, and the flange 432 are also shown. As can be appreciated, the flange 432 has an opening and the nipple 420 has a hollow body though which a liquid may flow through and out the openings 422 and 424.

Figure 19:
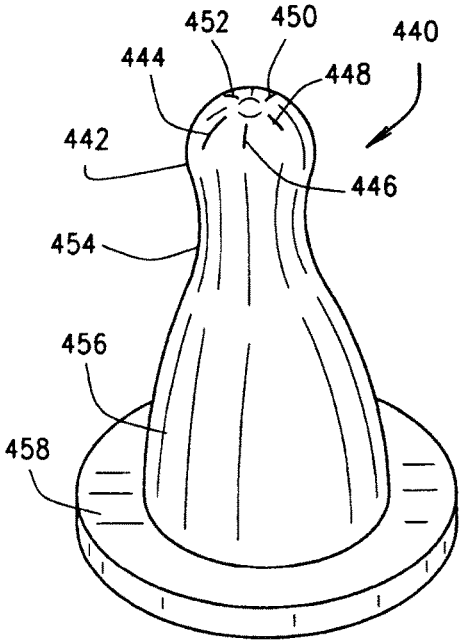
FIG. 19 is a perspective view of another embodiment of a nipple constructed according to the present disclosure.
Figure 20:
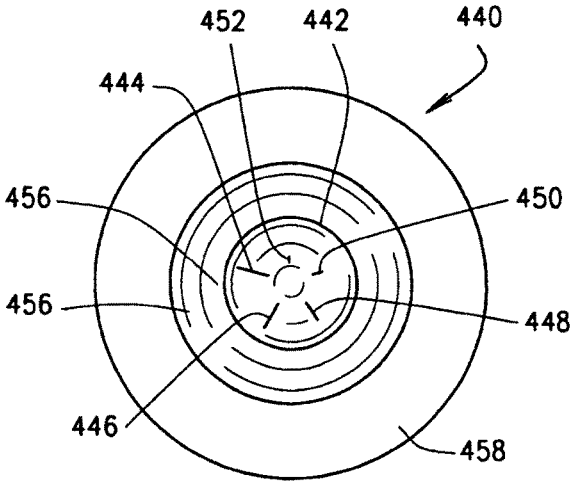
FIG. 20 is a top view of the nipple shown in FIG. 19.

FIGS. 19 and 20 illustrate another embodiment of a nipple 440 constructed according to the present disclosure. The nipple 440 comprises a top nipple portion 442 having openings 444, 446, 448, 450, and 452. The openings 444, 446, 448, 450, and 452 are radially emplaced and having varying lengths with the length of the opening 444 being the longest and the length of the opening 452 being the shortest. In this particular embodiment, the opening 444 is next to the opening 452. The nipple 440 further comprises an intermediate concave section 454 which extends to a lower dome-shaped body or section 456 and then to a flange 458. Although not shown in this view, the nipple 440 has an open bottom and a generally hollow body. Liquid, such an infant formula, may flow through the open bottom, the hollow body, and out through the openings 444, 446; 448, 450, and 452. As will be discussed in more detail herein, although only the openings 444, 446, 448, 450, and 452 are shown, it is contemplated and possible to have more or less openings with each of the openings having a different length than the other openings.

Figure 21:
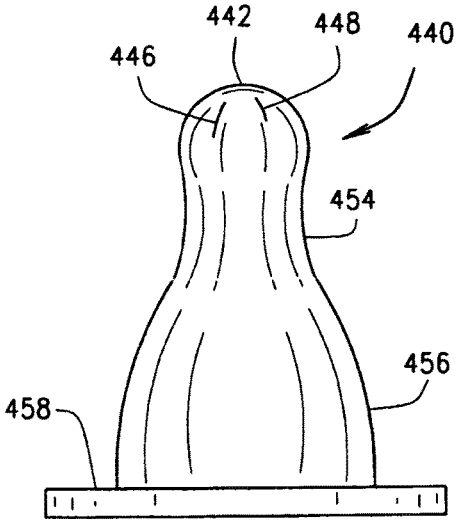
FIG. 21 is a side view of the nipple shown in FIG. 19.

FIG. 21 depicts a side view of the nipple 440 in which the openings 446 and 448 are visible. The nipple 440 is also shown to have the top nipple portion 442, the concave section 454, the dome-shaped body 456, and the flange 458. This particular orientation of the nipple 440 shows how the nipple 440 may be orientated toward the bottom of a mouth of an infant.

Figure 22:
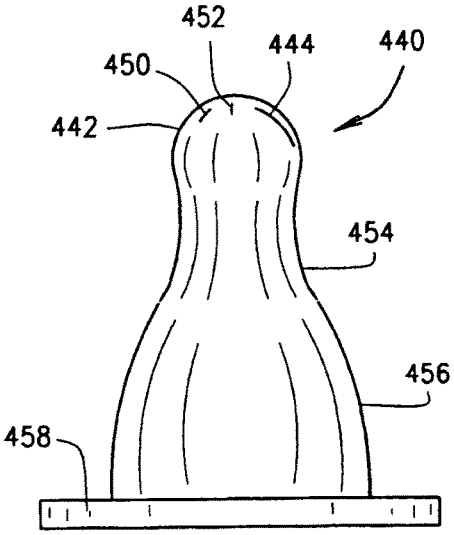
FIG. 22 is a side view of the nipple shown in FIG. 21 being rotated.

FIG. 22 shows another side view of the nipple 440 in which the openings 444, 450, and 452 are visible. The opening 444 is shown to be longer in length than the opening 452. Also, the opening 450 is longer in length than the opening 452. Other portions of the nipple 440, such as the top nipple portion 442, the concave section 454, the dome-shaped body 456, and the flange 458, are illustrated.

Figure 23:
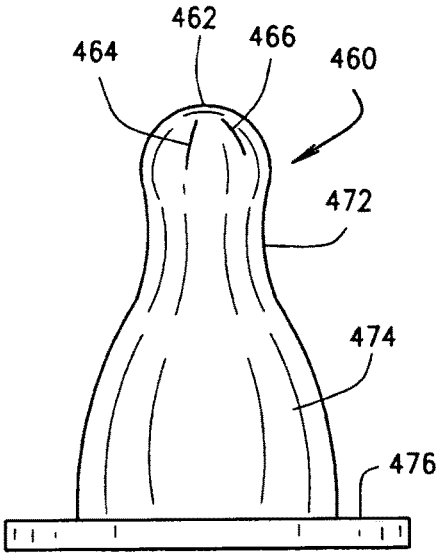
FIG. 23 is a side view of another embodiment of a nipple constructed according to the present disclosure.
Figure 24:
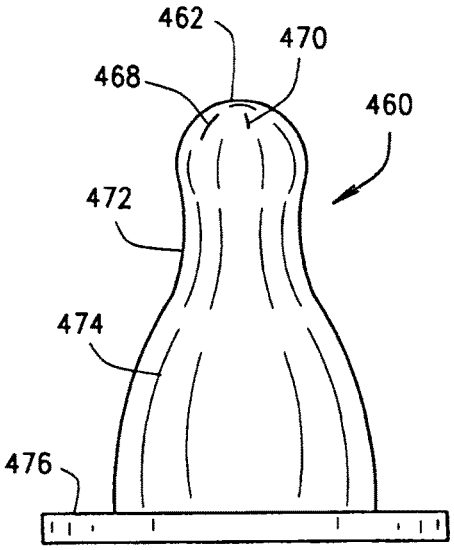
FIG. 24 is a side view of the nipple shown in FIG. 23 being rotated.

With particular reference now to FIGS. 23 and 24, another embodiment of a nipple 460 is illustrated. This nipple 460 is similar to the nipple 440 with the exception that one of the openings, such as the opening 448, has been not been formed in the nipple 460. In particular, the nipple 460 has a top nipple portion 462 having openings 464, 466, 468, and 470. The openings 464, 466, 468, and 470 each have different and varying lengths with the length of the opening 464 being the longest and the length of the opening 470 being the shortest. The nipple 460 further comprises an intermediate concave section 472 which extends to a lower dome-shaped body or section 474 and then to a flange 476.

Figure 25:
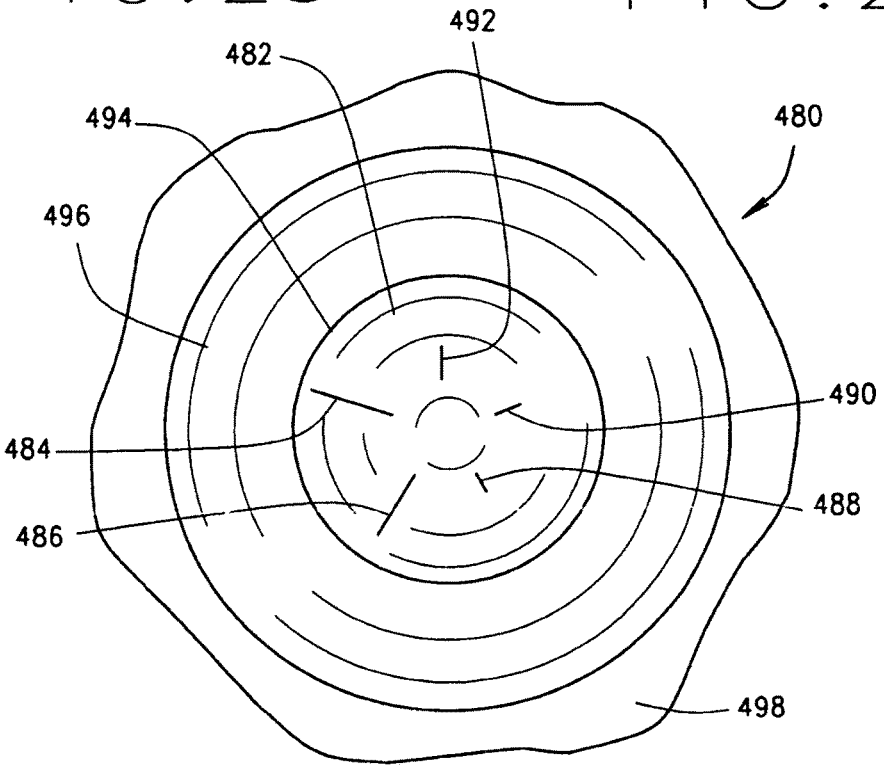
FIG. 25 is a top view of yet another embodiment of a nipple constructed according to the present disclosure.

FIG. 25 is yet another embodiment of a nipple 480 constructed according to the present disclosure. The nipple 480 has a top nipple portion 482 having openings 484, 486, 488, 490, and 492 formed therein. The openings 484, 486, 488, 490, and 492 each have different and varying lengths. The length of the opening 484 being the longest and the length of the opening 488 being the shortest. One difference between the nipple 480 and the nipple 460 is that in the nipple 480 the longest opening 484 is not next to the shortest opening 488. The nipple 480 also has an intermediate concave section 494 which extends to a lower dome-shaped body or section 496 and then to a flange 498.

Figure 26:
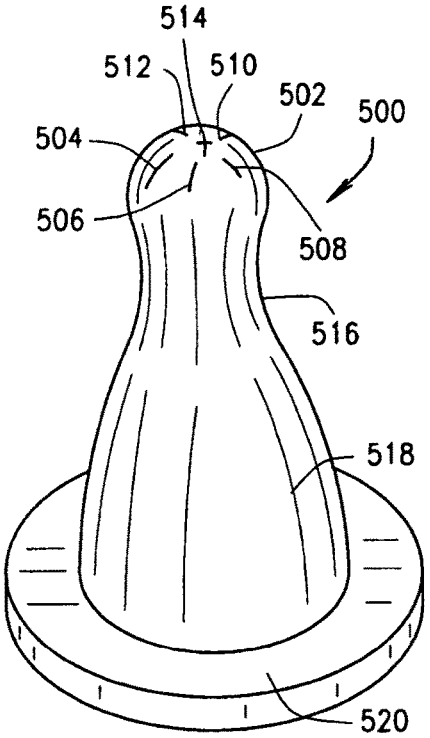
FIG. 26 is a perspective view of another embodiment of a nipple constructed according to the present disclosure.
Figure 27:
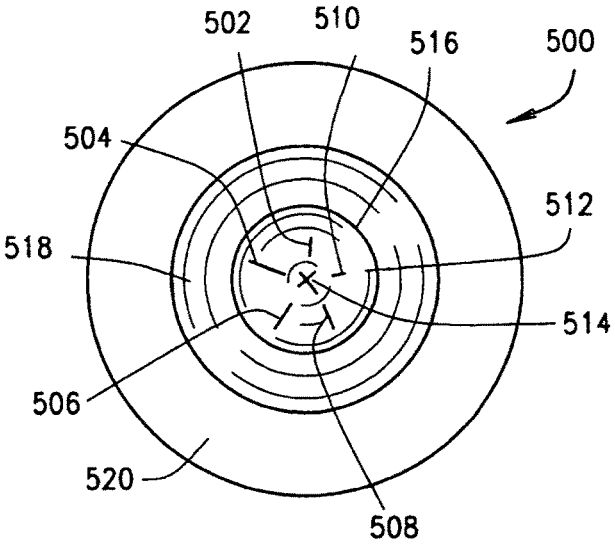
FIG. 27 is a top view of the nipple shown in FIG. 26.

Referring now to FIGS. 26 and 27, another embodiment of a nipple 500 constructed according to the present disclosure is shown. The nipple 500 has a top nipple portion 502 having radial openings 504, 506, 508, 510, and 512 surrounding a central opening 514. The central opening 514 may be similar to the 310 illustrated in FIG. 7. The central opening 514 is made at various angles tangentially to the surface. This facilitates variation of the flow of liquids from within a bottle. In this particular construction, the longest opening 504 is across from the shortest opening 512. Thus, the cluster of slots or radial openings adjacent to the longest opening 504 is what provides for the greatest flow of formula from the nursing bottle. And, the cluster of slots or radial openings adjacent to the shortest opening 512, provides for the lesser flow of formula from the nursing bottle. These flows are generally in the capacity of that as stated hereinafter. The nipple 500 also comprises an intermediate concave section 516 which extends to a lower dome-shaped body or section 518 and then to a flange 520. Thus, with the shortest slit opening in the nipple, as at 512, being opposite from the longest slit opening 504, more of the formula will flow from the bottle when the slit 504 is located downwardly of the nipple when it is inserted into the infant's mouth. But, when the bottle is rotated approximately 180°, and the slit 512, the shortest, is located at the bottom of the nipple as inserted, a much lesser flow of fluid will occur. As previously reviewed, and as summarized, when the larger or longest slit is located at the bottom of the nipple, it has been found that there occurs a faster flow rate of a formula from the bottle during usage. That flow rate, through testing, has been the fastest flow rate encountered, and it may be about one ounce per minute of flow of formula from the bottle. But, when the shorter slit 112 is located downwardly of the nipple, when inserted into the infant's mouth, it has been found that a slower rate of flow of formula occurs. It has been determined, through testing, to be at about a one ounce per minute and 45 seconds, for its flow rate. Thus, the flow of formula from the bottle can be controlled depending upon its positioning within the infant's mouth. And, it is just as likely, as previously reviewed, that indicia may be applied either upon the nipple, in association with these various lengths of slits, to indicate when a fast flow rate may be obtained, or a slow flow rate may be obtained, depending upon the location and positioning of the nursing bottle within the infant's mouth. Or, such indicia may be placed upon the bottle itself, and the nipple properly aligned when assembled, with formula therein, to indicate when the desired flow rate can be obtained, depending upon the positioning of the nursing bottle within the infant's mouth.

Figure 28:
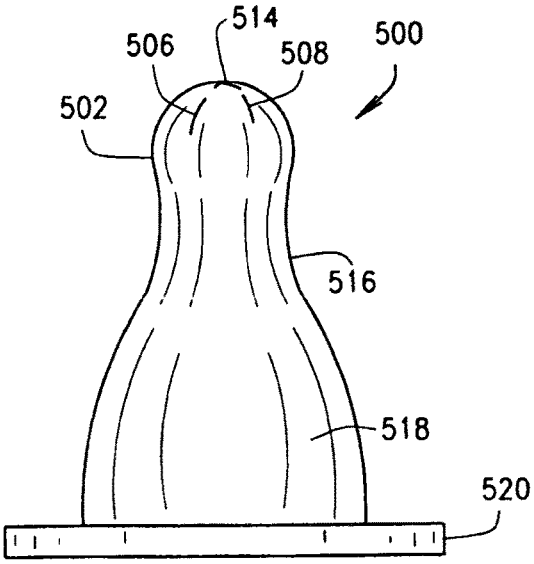
FIG. 28 is a side view of the nipple shown in FIG. 26.

FIG. 28 depicts the nipple 500 orientated so that the openings 506 and 508 and the central opening 514 are visible. The nipple 500 is also shown to have the top nipple portion 502, the concave section 516, the dome-shaped body 518, and the flange 520.

Figure 29:
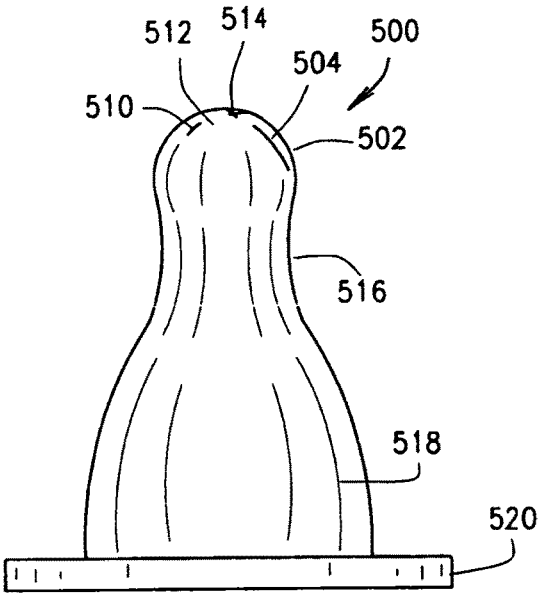
FIG. 29 is a side view of the nipple shown in FIG. 28 being rotated.

FIG. 29 illustrates the nipple 500 being orientated to show the openings 504, 510, and 512 and the central opening 514. The top nipple portion 502, the intermediate concave section 516, the dome-shaped body 518, and the flange 520 are also shown in this particular view.

Figure 30:
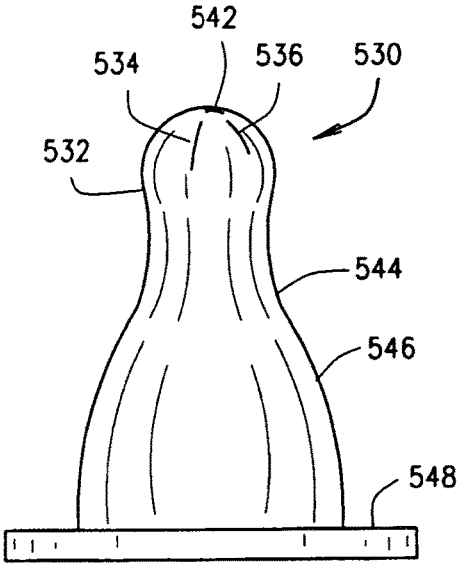
FIG. 30 is a side view of still another embodiment of a nipple constructed according to the present disclosure.
Figure 31:
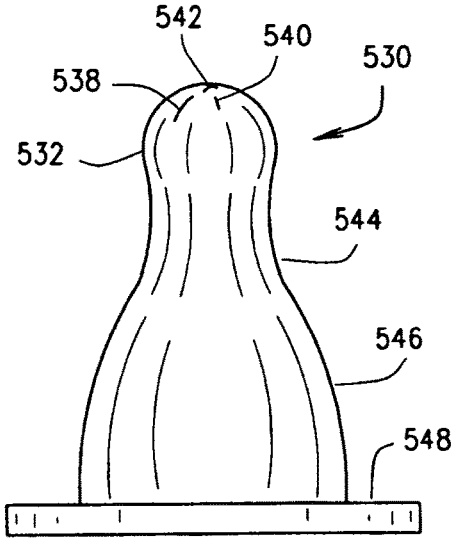
FIG. 31 is a side view of the nipple shown in FIG. 30 being rotated.

With reference now to FIGS. 30 and 31, another embodiment of a nipple 530 is illustrated. This nipple 530 is similar to the nipple 500 with the exception that one of the openings, such as the opening 508, has not been formed in the nipple 530. In particular, the nipple 530 has a top nipple portion 532 having openings 534, 536, 538, and 540 and a central opening 542. The openings 534, 536, 538, and 540 each have different and varying lengths with the length of the opening 534 being the longest and the length of the opening 540 being the shortest. The nipple 530 further has an intermediate concave section 544 which extends to a lower dome-shaped body or section 546 and then to a flange 548.

Figure 32:
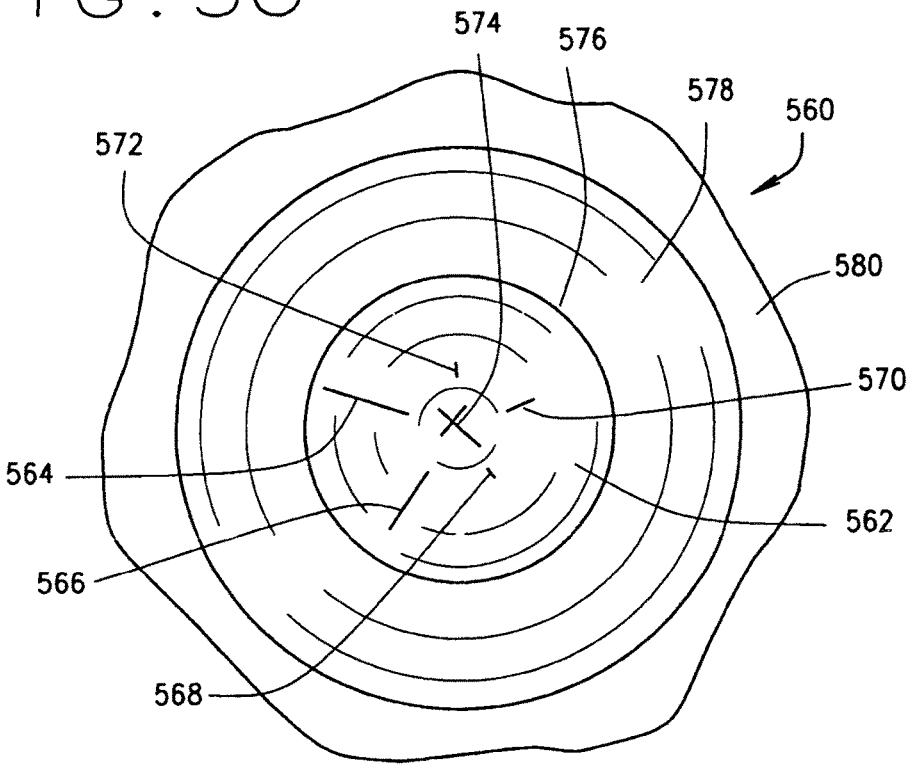
FIG. 32 is a top view of another embodiment of a nipple constructed according to the present disclosure.

FIG. 32 shows still another embodiment of a nipple 560 constructed according to the present disclosure. The nipple 560 has a top nipple portion 562 having openings 564, 566, 568, 570, and 572 and a central opening 574 formed therein. The openings 564, 566, 568, 570, and 572 each have different and varying lengths. The length of the opening 564 being the longest and the length of the opening 568 being the shortest. One difference between the nipple 500 and the nipple 560 is that in the nipple 560 the longest opening 564 is not next to the shortest opening 568. The nipple 560 also has an intermediate concave section 576 which extends to a lower dome-shaped body or section 578 and then to a flange 580. The central opening 574 is what is identified as the teaser opening or slit, and it provides for an initial and slow drippage of only drops of the formula from the nipple when the bottle is inverted. This is what is identified as the teaser type of opening for the nipple to initiate the incentive for the infant to accept and begin to manipulate the nipple to receive formula. This type of slit provided centrally of the nipple are generally formed tangentially, through a radial type of cut, normally performed with a razor edge cutting instrument.

Figure 33:
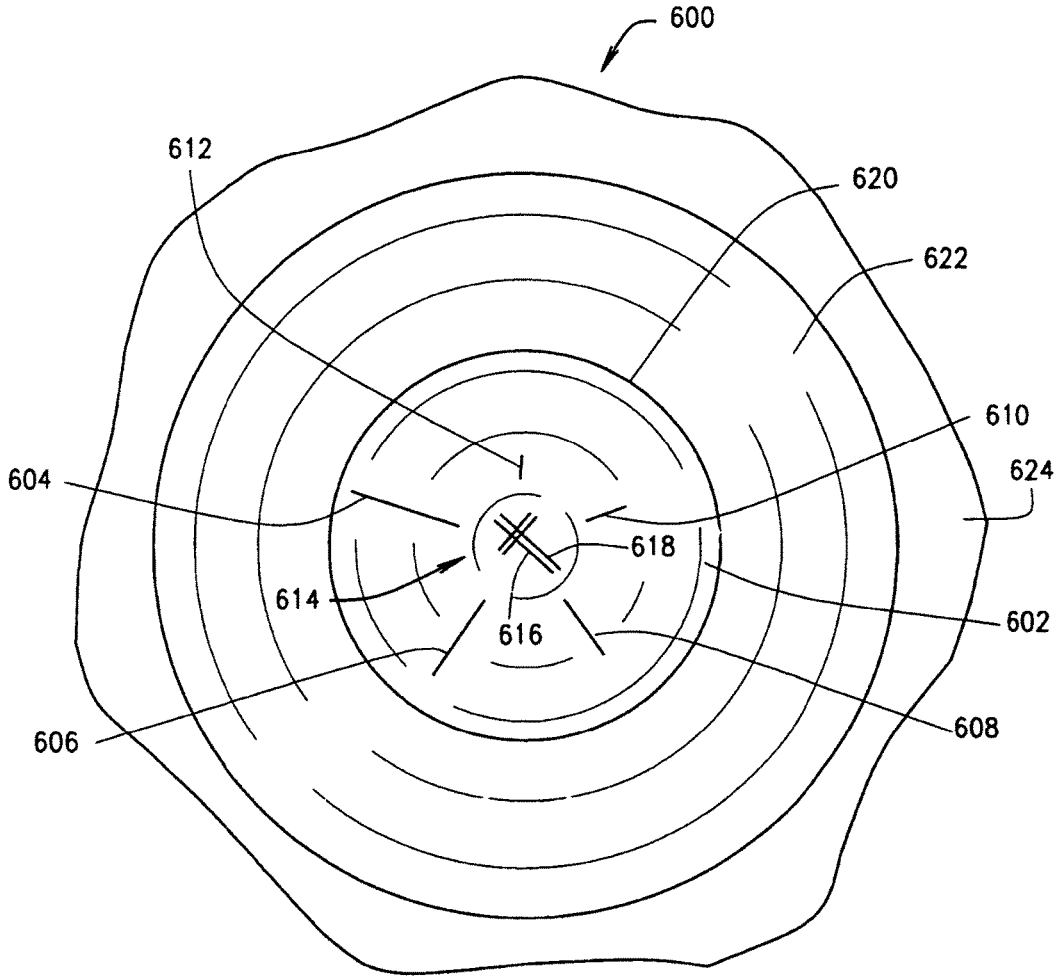
FIG. 33 is a top view of another embodiment of a nipple constructed according to the present disclosure.

With reference now to FIG. 33, another embodiment of a nipple 600 constructed according to the present disclosure is shown. The nipple 600 has a top nipple portion 602 having radially disposed openings 604, 606, 608, 610, and 612 surrounding a central opening 614 formed of two T-shaped openings 616 and 618. The openings 616 and 618 may be similar to the 310 illustrated in FIG. 7. The openings 616 and 618 are made at various angles tangentially to the surface. This facilitates variation of the flow of liquids from within a bottle. In this particular construction, the longest opening 604 is next to the shortest opening 612. The nipple 600 also comprises an intermediate concave section 620 which extends to a lower dome-shaped body or section 622 and then to a flange 624.

Although all of the various nipples or dispensers have been shown and described, it is also possible and contemplated that the dispensers may be a spout for a drinking cup for older children. The dispensers may also be used for a sports bottle. The dispensers may be located in any position on the closure. Also, a cover may be provided for the dispensers to maintain the hygiene of the dispensers. All of these features enable the emulation of a nipple portion of a natural breast during breast feeding.

From all that has been said, it will be clear that there has thus been shown and described herein a user controllable noncollapsible variable stream physiological dispenser. It will become apparent to those skilled in the art, however, that many changes, modifications, variations, and other uses and applications of the subject user controllable noncollapsible variable stream physiological dispenser are possible and contemplated. All changes, modifications, variations, and other uses and applications which do not depart from the spirit and scope of the invention are deemed to be covered by the disclosure, which is limited only by the claims which follow.

We claim:

1. A user controllable noncollapsible variable stream physiological dispenser for dispensing fluid from a vented container, comprising:

a vented container;

a nipple having a top nipple portion which extends to an intermediate concave section which extends to a lower dome-shaped body and to a flange, the flange used to be held to the vented container by a collar, the top nipple portion having a central opening, a first opening slit having a first length, a second opening slit having a second length, a third opening slit having a third length, a fourth opening slit having a fourth length, a fifth opening slit having a fifth length, and sixth opening slit having a sixth length, with the opening slits positioned radially around the central opening with the first opening slit being adjacent to the sixth opening slit, the nipple having an open bottom provided at the flange with the nipple having a hollow body through which a liquid may pass from the open bottom through the body and out the central opening and the opening slits, all of said opening slits being of differing lengths from each other, and spaced outwardly and not in contact with the central opening;

the central opening and the opening slits are orally activated to allow liquid to flow at a desired rate when pressure is applied to the top nipple portion, and each of the lengths being different from each other to allow variable flow rates from said nipple, with the length of the first opening slit having the longest length of all of the slits, and the length of the sixth opening slit having the shortest length of all of the slits.

2. The user controllable noncollapsible variable stream physiological dispenser for a vented container of claim 1, wherein when the sixth opening slit of the nipple is located downwardly within a mouth of an infant during a feeding, a much lesser quantity of liquid will be delivered from the vented container to the infant during the feeding; and when the first opening slit of the nipple is inserted downwardly within the mouth of the feeding infant, a much greater quantity of liquid will be delivered from the vented container to the infant during the feeding.

3. The dispenser of claim 2, wherein indicia applied to one of the nipple and nursing bottle identifying full flow from the longest slit during an infant feeding, and indicia provided in alignment with the shortest slit opening in the nipple identifying the potential for obtaining a lowest flow of formula from the nipple and its nursing bottle during usage.

4. The dispenser of claim 1 wherein the longest slit is next to the shortest slit.

5. The dispenser of claim 1 wherein the longest slit is not next to the shortest slit.

* * * * *